US006988281B1

(12) United States Patent
Jerome et al.

(10) Patent No.: US 6,988,281 B1
(45) Date of Patent: Jan. 24, 2006

(54) KNEEPAD

(76) Inventors: Jay B. Jerome, 715 Hammer Ct., Elyria, OH (US) 44036; Laurie B. Rudiy, 2505 Granger Rd., Medina, OH (US) 44256

( * ) Notice: Subject to any disclaimer, the term of this patent is extended or adjusted under 35 U.S.C. 154(b) by 0 days.

(21) Appl. No.: 10/186,521

(22) Filed: Jul. 1, 2002

Related U.S. Application Data

(60) Provisional application No. 60/306,527, filed on Jul. 20, 2001, provisional application No. 60/371,926, filed on Apr. 12, 2002.

(51) Int. Cl.
*A41D 13/00* (2006.01)

(52) U.S. Cl. ..... 2/24

(58) Field of Classification Search ..... 2/23, 2/267, 227, 79, 24, 268, 247, 249, 250, 251, 2/69

See application file for complete search history.

(56) References Cited

U.S. PATENT DOCUMENTS

| | | | | | |
|---|---|---|---|---|---|
| 891,533 | A | * | 6/1908 | Gibbs | 2/24 |
| 1,571,088 | A | | 1/1926 | Buchanan | |
| 2,561,872 | A | | 7/1951 | Krinick | 2/24 |
| 2,568,083 | A | * | 9/1951 | Mitchell | 2/231 |
| 3,346,877 | A | * | 10/1967 | Zirves | 2/24 |
| 3,786,804 | A | * | 1/1974 | Lewis | 602/16 |
| 3,913,181 | A | * | 10/1975 | Walker | 24/67.9 |
| 4,490,855 | A | | 1/1985 | Figgie, III et al. | 2/24 |
| 4,561,123 | A | | 12/1985 | Hull | 2/23 |
| 4,561,124 | A | | 12/1985 | Thompson | 2/24 |
| 4,932,134 | A | | 6/1990 | Meadows | |
| 5,134,726 | A | | 8/1992 | Ross | 2/23 |
| 5,481,784 | A | * | 1/1996 | Sinaiko | 24/67.9 |
| 5,617,587 | A | | 4/1997 | Marchbanks | 2/247 |
| 5,727,252 | A | | 3/1998 | Oetting et al. | 2/24 |
| 5,732,412 | A | | 3/1998 | Holden | 2/23 |
| 5,920,902 | A | | 7/1999 | Crampton | 2/24 |
| 6,014,771 | A | | 1/2000 | Kirven | 2/23 |
| 6,058,505 | A | | 5/2000 | Bettencourt | |
| 6,279,160 | B1 | | 8/2001 | Chen | |
| 6,347,403 | B1 | * | 2/2002 | Wilcox | 2/23 |
| 6,704,938 | B2 | * | 3/2004 | Crockett | 2/23 |

OTHER PUBLICATIONS

Henry, Lois, "Entrepreneur discovers tool for all trades." The Bakersfield Californian, Business section, Apr. 13, 1996.

Web page printout of Dexter Meadows Enterprises, www.dextermeadows.com; Apr. 14, 2004.

* cited by examiner

*Primary Examiner*—Tejash Patel

(57) ABSTRACT

A strapless kneepad kit for installing releasable fasteners to the kneepad and to corresponding locations on the seams of work pants or jeans in the kneecap area. It will eliminate the straps that encircle the leg. It consists of hardware, tools and instructions. The basic hardware comes in rust-free brass or standard military finish. The tools are easy to use with a hammer for installation. The kit can be used on new or used kneepads, and they attach and detach in a snap.

30 Claims, 4 Drawing Sheets

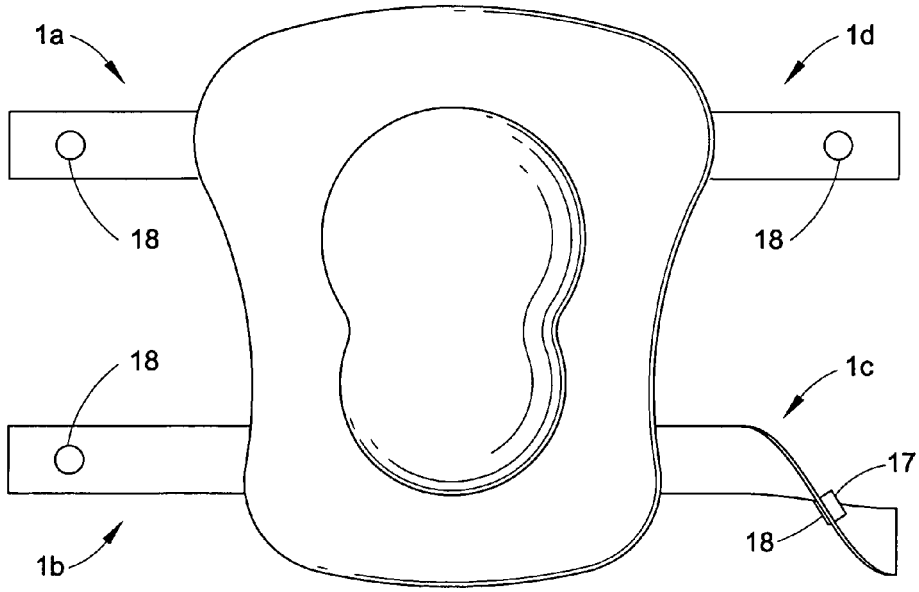
FIG. 1
FIG. 2
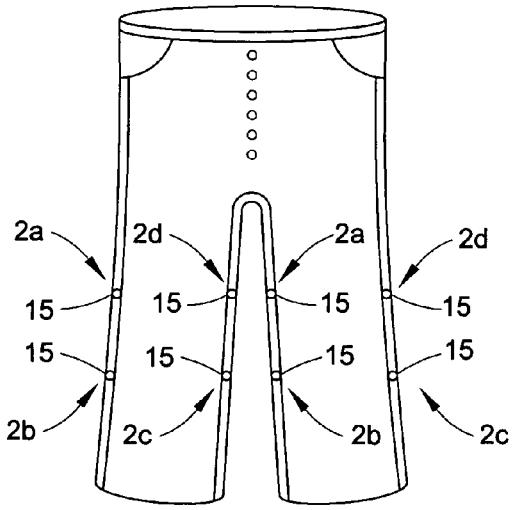
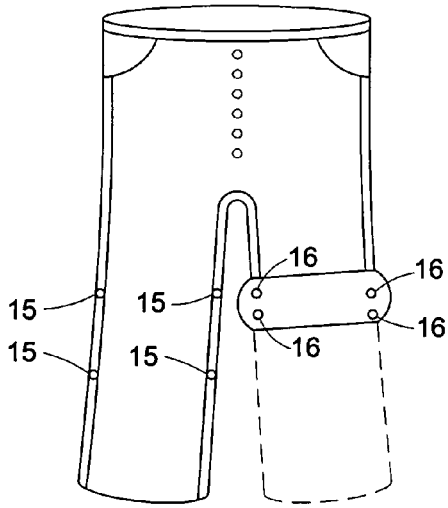
FIG. 3

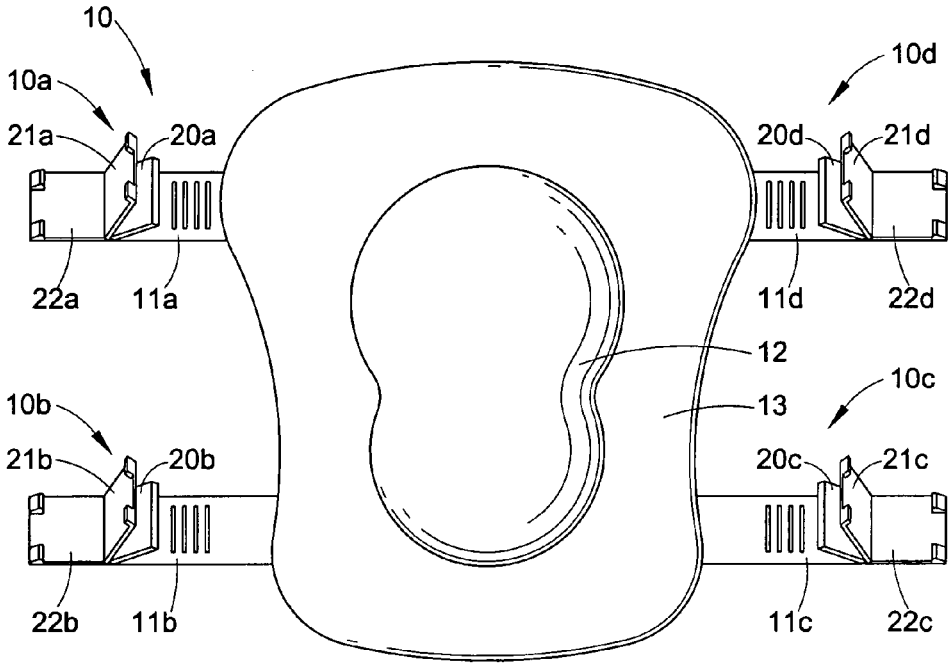
FIG. 6
FIG. 7
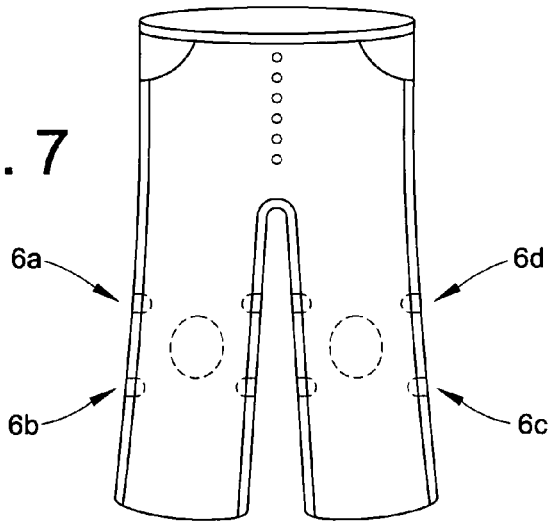

KNEEPAD

PRIOR APPLICATIONS

This Application is entitled to the benefit of Provisional Patent Application, Jul. 20, 2001 Ser. No. 60/306,527 And the Provisional Patent Application, Apr. 12, 2002 Ser. No. 60/371,926

FIELD OF THE INVENTION

This Invention relates in general to kneepads and in particular to a strapless non-constricting method of attaching the pads directly to the pant.

BACKGROUND OF THE INVENTION

The Invention was borne out of the desire to find a secure and healthy way of keeping the kneepad in position without the use of binding straps around the back of the leg.

DESCRIPTION OF RELATED ART

When kneeling, all the body weight is on the patella. Kneepads are necessary for all those who spend a lot of time on their knees. The traditional way of protecting the kneecap has been to wear some degree of kneepad; keeping it in place with two straps attached to the pad and tied, buckled, or looped with VELCRO hook and loop material around the back of the leg. These straps are tight and uncomfortable and create a tourniquet effect by cutting off the blood supply to the lower extremities, creating the possibility of tissue damage as well as a possibility of forming blood clots. And the straps cause welts and dents in the wearer's flesh. And the lack of airflow makes the kneedpad hot for the wearer.

Kneepads are for protection of the kneecap, but are also, a valuable functional tool for the occupational wearer. The function is as broad or as specific as the kneeling surface of the particular job. Some kneepads are designed and textured to keep the worker in position while kneeling, such as the cement worker on hard concrete. He needs to stay in place and use his upper body for smoothing the concrete. The roofers have heavy rubberized pads that act as their base to keep them from falling. The tile installer needs a hard shell so he can pivot on his knees to change his position, while kneeing on tile or marble. And the carpet installer slams his knee into a carpet stretcher apparatus for stretching and smoothing out the carpet during installation. It is important for all of them, to have the agility of freedom of movement, at the same time, keeping the kneepad firmly in place.

In the last few years, the sports such as skateboarding, bicycling, and roller-blading have also taken on a tremendous need for knee and elbow protection. In this case, the knee protection is desired more for the possibility of an accidental contact with a hard or rough surfaces. In the event of a fall or collision the kneepad would soften the impact, if in proper position.

Traditionally, kneepad wearers had only the one option of tightly strapping the pads around the leg, as in U.S. Pat. No. 1,571,088 issued April 1925 to Buchanan and U.S. Pat. No. 4,490,855 issued June 1983 to Figgie. The straps had the tendency to twist, or slip causing the wearer to stop and re-adjust the pad back in position of the knee area. The most important drawback is the health issue. The straps are uncomfortable and could leave welts or burns on the backside of the leg. Also, they constrict the blood flow and airflow to the lower extremities with increased pressure on the veins and arteries.

One attempt to apply kneepads directly to the pant was U.S. Pat. No. 2,561,872 issued July 1951 to Krinick, where the fasteners were attached to a sheet member. The member was permanently bonded with adhesive to the front of the trouser leg. Other sheet members were then, layered and attached with fasteners. The fasteners were incorporated in the body of the member, as not to be imposed between the ground and the knee of the person. Other solutions have been sewing pockets at the knee area of the work pant as in U.S. Pat. No. 4,561,124 issued December 1985 to Thompson and U.S. Pat. No. 5,134,726 issued August 1991 to Ross, where as the worker would glue a pocket either outside or on the inside of the pant leg. As attested in said patents, it would be flexible and inexpensive, but it would be messy and too flexible for some of the heavier workers' kneepads. And would limit the choice of different kneepads that would compliment this type of holding device.

Others have tried permanently attaching VELCRO hook and loop material on both the pant leg and the kneepad such as in U.S. Pat. No. 4,561,123 issued December 1985 to Hull, where he suggested adhering VELCRO hook and loop material on pants and pad with an adhesive in a horizontal position in the knee area. An U.S. Pat. No. 5,732,412 issued September 1996 to Holden, who suggested VELCRO hook and loop material in a vertical position. The stress on the VELCRO hook and loop material if used on heavy non-flexible pads, would be great. When the pad are detached, the VELCRO hook and loop material picks up lint and anything loose and won't wash well and will eventually wear out.

All of the above mentioned kneepad systems supply comfort to the kneecap, when properly positioned; but still could be more comfortable for the rest of the leg. The combined kneepad and attaching device should be dependable and more easily attached and detached. The wearer needs the ability to alternate between his or her preferred kneepads. The kneepad design and texture varies for every job.

OBJECT OF INVENTION

Accordingly, besides the objects and the advantages of the secure and healthy means of attaching kneepads directly to the work or play pants, several object and advantages of the present invention are:

(a) to provide a fastening device to work with used kneepads, newly purchased kneepads, and pads of the future;

(b) to provide a fastening system that will allow for maximum comfort for the entire leg;

(c) to provide a fast and easy means of attaching and detaching the kneepad;

(d) to provide a fastening device that can be covered or colored in a variety of colors and fabrics, giving the ability to blend or match the pant;

(e) to provide a military finish for the men of the armed forces.

SUMMARY OF THE INVENTION

This invention will make the wearing of kneepads more comfortable and eliminate the risk of blood clots and nerve damage due to the strangulation effect of straps tightly pulled around the leg. For a kneepad to work properly, it has to be securing over the center of the kneecap and be balanced equally above the knee and below the knee for optimal protection and comfort. This invention gives the wearer agility in choosing many types of kneepads to coordinate with many different styles of work or play pants. This Invention will hold the heaviest kneepad in place. The first releasable fasteners are affixed permanently in the seams of the pant above the knee and the second releasable fastener affixed of equal distance below the knee and the corresponding first and second releasable fasteners are affixed permanently to the kneepad. The kneepad and pant leg releasable fasteners fit together in a snap when needed. Also, the clip fastening system would apply the same way, only the pant material will serve as the attaching device. The clip grabs the material of the pant above the knee in the general area of the outer and inner seams. And the second set of clips grab the material below the kneecap, in the general area of the outer and inner seams. When the knee is flexed, the kneepad will stay with the pant and give full coverage. When the wearer is in a standing position, the kneepad will hang on the pant leg, away from the body, and allow airflow. It allows the wearer to have the versatility of having many different pads for the many different types of jobs. When the job is done the pads are easily disengaged and the pants can go in the laundry and the pads can be used the same way on another pair of pants.

The present invention, therefore, provides a kneepad for attachment to clothing comprising an outer surface, an inner cushioning surface connected to said outer surface, a plurality of straps attached about the periphery of said inner cushioning surface, and releasable locking clips permanently attached to ends of said straps, wherein said locking clips comprise opposing upper and lower grabbing jaws and an upper locking means.

The present invention also provide a kneepad for attachment to clothing comprising an outer substantially rigid protective surface, an inner cushioning surface connected to said outer surface, a plurality of straps attached about the periphery of said inner cushioning surface, and fastening means attached to ends of said straps.

BRIEF DESCRIPTION OF DRAWINGS

FIG. 1 is the frontal view of an existing kneepad with Four Corners

FIG. 2 is the frontal view of a pant consisting of two legs including seams

FIG. 3 is similar to FIG. 2 with one leg of pant rolled up to show interior of pant leg

Fasteners 15 and 16 are the pant hardware

Fasteners 17 and 18 are the kneepad hardware

FIG. 6 is the kneepad with a clip fastening device

Fasteners 10 is the clip fastening device

Figure 8:
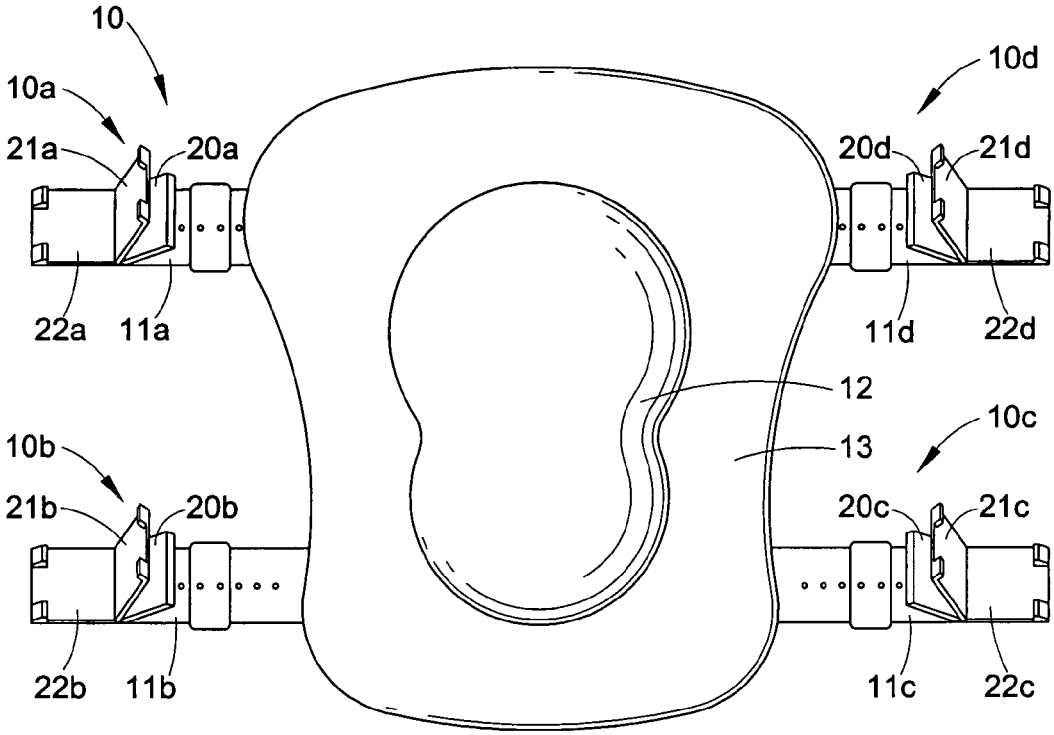

FIG. 7 is similar to FIG. 2. And displays the general area for applying 10 to the pant FIG. 8 is a front view of one embodiment of the knee pad having adjustable straps.

An improved kneepad is provided. In one embodiment, the kneepad comprises an outer surface and an inner cushioning surface that is in connection with the outer surface. The kneepad also includes a plurality of straps that are attached about the periphery of the inner cushioning surface. A releasable locking clip is attached to an end of each strap. The locking clips include opposing upper and lower grabbing jaws and an upper locking means to lock the jaws onto clothing. In a certain embodiment, the locking means is a locking plate.

In another embodiment, the kneepad for attachment to clothing includes an outer substantially rigid protective surface, an inner cushioning surface connected to the outer surface, a plurality of straps attached about the periphery of the inner cushioning surface, and fastening means attached to ends of said straps to releasable attach the kneepad to clothing.

DESCRIPTION OF THE PREFERRED EMBODIMENT OF THE INVENTION

Referring now to the drawing. FIG. 1 is the frontal view of an existing kneepad with four straps or appendages, one on each corner, which will conform to the invention. Area 1*a* is the approximate location for applying fasteners 17 and fasteners 18. Area 1*b* is the approximate location for applying fasteners 17 and fasteners 18. Area 1*c* is the approximate location for applying fasteners 17 and fasteners 18. Area 1*d* is the approximate location for applying fasteners 17 and fasteners 18. Where fastener 17 penetrates from the under side of the kneepad strap and fastener 18 mates to it from the outside of the kneepad strap to make a permanent kneepad coupling device.

It should be noted that the hardware comprising of 17, and 18 can consist of many different types of firm material such as steel, brass, plastic, and the like. Also, it can be decorative in colors and covered with fabrics or in a military finish to blend and or match the pad.

Another example of the Invention, is installing more than the mentioned four sets of snaps. Thus, creating a more versatile strap. The extra snaps would give the wearer a greater selection of pant leg widths, which would work with the kneepad. The unused portion ends of the strap, could be cut off and discarded.

FIG. 2 is the frontal view of the pant, consisting of a waistband, crotch, and outer and inner seams and having a kneecap area.

FIG. 3 is similar to FIG. 2 with one leg turned inside out to give the inside view of the pant to illustrate the positioning of fastener 16, where fastener 16 protrudes from the inside of the pant material in the 2*a* area to mate with fastener 15 on the outside of the pant material in the 2*a* area and form the permanent pant-coupling fastener.

Area 2*b* is the approximate location for applying fastener 15 and fastener 16 that fit together in the same manner Area 2*c* is the approximate location for applying fastener 15 and fastener 16 that fit together in the same manner Area 2*d* is the approximate location for applying fastener 15 and fastener 16 that fit together in the same manner It should be noted that this set of hardware also, comes in various materials, such as metals, and plastic or the like and can come in decorative colors and fabric covered, that would blend or match the pant or jean or sports outfit. They can be applied to any pant for work or play, that has a knee area and seams on the sides.

Another variation could be to install more than the suggested set of snaps on the seams of the pant, or installing a group of snaps on a strip of material. The strip could then be secured, in the general area of the pant seams, thus giving the wearer a multiple choice of positions for attaching his or her knee protection. And it would allow the user a greater choice of different sizes and shapes of his or her existing pads or newly purchased pads now available.

Figure 4:
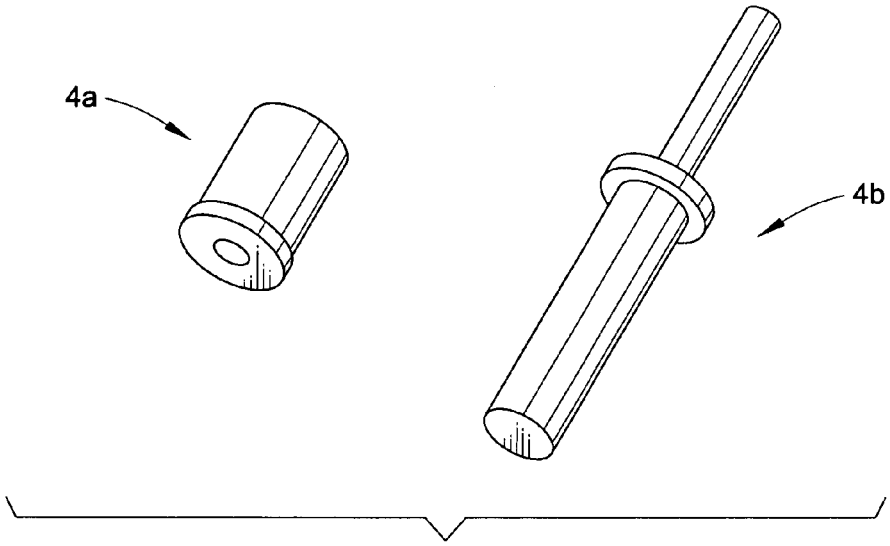
FIG. 4 is the two-part tool system consisting of a punch (4*a*) and a die (4*b*)

FIG. 4 is the two-part tool system for applying fasteners 17 and 18 and 16 and 15 respectively to FIG. 1 and FIG. 2. It consists of tool 4*a* being the die and tool 4*b* being the punch.

Figure 5:
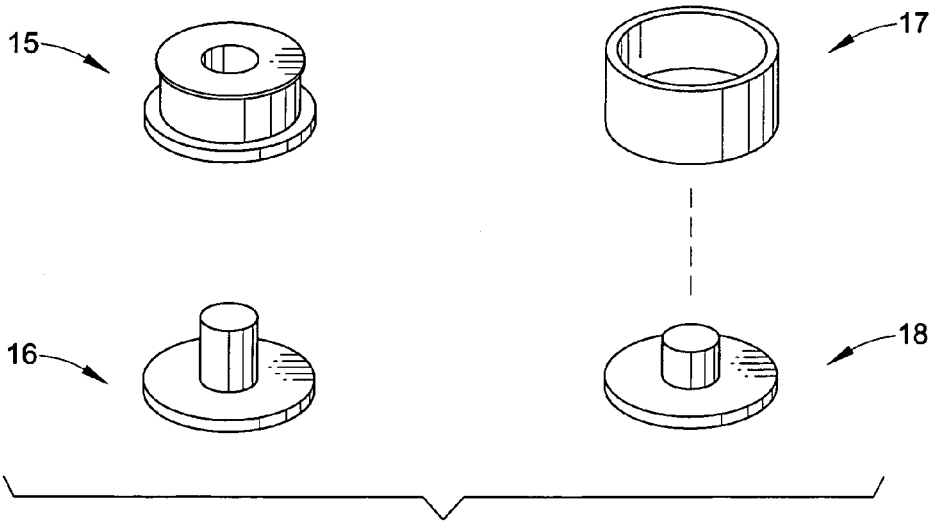
FIG. 5 is hardware needed to attach and detach FIG. 1 to FIG. 2 and FIG. 3

FIG. 5 is the two-part hardware system that will be the means of attaching and detaching FIG. 1 to FIG. 2

(a) fastener 15 being the outer pant hardware to permanently mate with fastener 16, the inner pant hardware, creating the first half of the coupling system (b) fastener 17 being the inside of the pad hardware to permanently mate with fastener 18 on the outer side of the pad to create the second half of the coupling system FIG. 6 is a fontal view of a kneepad 10 comprising four corners and four straps 11*a*–11*d* which illustrates an alternate embodiment of the invention in which clips 10*a*–10*d*, such as alligator clips or suspender clips are installed on each of the four corners or straps 11*a*–11*d* of the kneepad. Thus, allowing the kneepad 10 to be attached to the pant in a material grabbing effect. Clips 10*a*–10*d* include opposing upper 21*a*–21*d* and lower 22*a*–22*d* jaws and locking tabs 20*a*–20*d*. The length of the straps 11*a*–11*d* would depend on the desired position of the clips 10*a*–10*d* on the pant for a secure fit and could be left adjustable in length for flexibility. Again, giving the user a choice of the width of the leg material of the pant and a choice as to where, he or she wants to use the clips. The other benefit is that the pants do not require additional hardware or an other seam for attachment the clips 10*a*–10*d*.

Yet another example of attaching directly to the pant could be the use of buttons and loops constructed in the same manner as the snaps. The buttons could be located on the pant in the seam areas and the loop could be on the adjacent area of the pad. Or it could also work in the reverse, whereas the button could be positioned on the pad and the loop or loops could be installed on the pant material.

FIG. 7 is the frontal view of the pant, consisting of a waistband, crotch, and a kneecap general area between the waistband and the full length of the pant. Areas 7*a*, 7*b*, 7*c*, and 7*d* are the suggested general locations corresponding to the clips 10*a*, 10*b*, 10*c*, and 10*d* for attaching kneepads.

While the preferred embodiments of the invention have been described, modifications can be made and other embodiments can be made and other embodiments may be devised without departing from the spirit of the invention and the scope of the appended claims.

What is claimed is:

1. A kneepad for attachment to clothing comprising:

an outer surface;

an inner cushioning surface connected to said outer surface;

a plurality of straps attached about the periphery of said inner cushioning surface; and releasable locking clips attached to ends of said straps, wherein said locking clips comprise opposing upper and lower grabbing jaws and locking means.

2. The kneepad of claim 1, wherein said releasable locking clips are permanently attached to ends of said straps.

3. The kneepad of claim 1, wherein said straps are flexible.

4. The kneepad of claim 1, wherein the straps are of adjustable length.

5. The kneepad of claim 1, wherein said locking clips are suspender clips.

6. The kneepad of claim 1, wherein said locking clips comprise a material selected from steel, brass, and plastic.

7. The kneepad of claim 1, wherein said locking clips are covered with a fabric.

8. The kneepad of claim 1, wherein said locking clips are provided with a military finish.

9. The kneepad of claim 1, wherein kneepad comprises four straps attached about the periphery of said inner cushioning surface.

10. The kneepad of claim 9, wherein each of said straps is attached near one of the four corners of said inner cushioning surface.

11. The kneepad of claim 9, wherein said releasable locking clips are permanently attached to ends of said straps.

12. The kneepad of claim 9, wherein said straps are flexible.

13. The kneepad of claim 9, wherein the straps are of adjustable length.

14. The kneepad of claim 9, wherein said locking clips are suspender clips.

15. The kneepad of claim 9, wherein said locking clips comprise a material selected from steel, brass, and plastic.

16. The kneepad of claim 9, wherein said locking clips are covered by a fabric.

17. The kneepad of claim 9, wherein said locking clips are provided with a military finish.

18. A kneepad for attachment to clothing comprising:

an outer substantially rigid protective surface;

an inner cushioning surface connected to said outer surface;

a plurality of straps attached about the periphery of said inner cushioning surface; and fastening means attached to ends of said straps, wherein said fastening means comprise releasable locking clips comprising hingedly attached opposing upper and lower jaws and a hingedly attached locking means.

19. The kneepad of claim 18, wherein said fastening means are permanently attached to ends of said straps.

20. The kneepad of claim 18, wherein said straps are flexible.

21. The kneepad of claim 18, wherein the straps are of adjustable length.

22. The kneepad of claim 18, wherein said fastening means comprise a material selected from steel, brass, and plastic.

23. The kneepad of claim 18, wherein said fastening means are covered with a fabric.

24. The kneepad of claim 18, wherein kneepad comprises four straps attached about the periphery of said inner cushioning surface.

25. The kneepad of claim 24, wherein each of said straps is attached near one of the four corners of said inner cushioning surface.

26. The kneepad of claim 24, wherein said fastening means are permanently attached to ends of said straps.

27. The kneepad of claim 24, wherein said straps are flexible.

28. The kneepad of claim 24, wherein the straps are of adjustable length.

29. The kneepad of claim 24, wherein said fastening means comprise a material selected from steel, brass, and plastic.

30. The kneepad of claim 24, wherein said fastening means are covered by a fabric.

* * * * *